United States Patent [19]

Sentoku

[11] Patent Number: 4,904,223

[45] Date of Patent: Feb. 27, 1990

[54] COIN SORTING APPARATUS

[75] Inventor: Hideshi Sentoku, Tokyo, Japan

[73] Assignee: Laurel Bank Machines Co., Ltd., Tokyo, Japan

[21] Appl. No.: 253,610

[22] Filed: Oct. 5, 1988

[30] Foreign Application Priority Data

Oct. 6, 1987 [JP] Japan ..... 62-252202

[51] Int. Cl.[4] ..... G07D 3/00

[52] U.S. Cl. ..... 453/7; 453/31

[58] Field of Search ..... 453/3, 5, 6, 7, 9, 10, 453/11, 31, 56

[56] References Cited

U.S. PATENT DOCUMENTS

| | | | |
|---|---|---|---|
| 748,934 | 1/1904 | Doldt | 453/14 |
| 3,396,737 | 8/1968 | Picollo | 453/5 |
| 3,991,778 | 11/1976 | Ushio et al. | 453/56 |

FOREIGN PATENT DOCUMENTS 56-88380 7/1981 Japan .

*Primary Examiner*—F. J. Bartuska

*Attorney, Agent, or Firm*—Fleit, Jacobson, Cohn, Price, Holman & Stern

[57] ABSTRACT

A coin sorting apparatus including a coin receiving section provided with a rotary disc for receiving various denominations of coins of various diameters, an excluding path including guide plate disposed at one side of the path and communicated with the rotary disc for engaging with a peripheral portion of the coin carried, guide member disposed at the other side of the excluding path and formed with a slant surface on which a larger diameter coin than the predetermined denomination of coin is engaged to climb up to be excluded from the excluding path and a lead wall for engaging with a coin other than the coin to be excluded from the excluding path and restricting portion disposed over the slant surface of the guide member and swingably mounted on the guide member for engaging the larger diameter coin introduced on the slant surface, a selecting path provided with selecting rail for excluding the smaller diameter coin smaller in diameter than the predetermined denomination of coins and pass them to a small coin container to select only the predetermined denomination of coin.

9 Claims, 5 Drawing Sheets

COIN SORTING APPARATUS

CROSS-REFERENCE TO THE RELATED APPLICATIONS

The present application is related to a co-pending U.S. patent application Ser. No. 170,379 filed on Mar. 18, 1988 entitled "COIN HANDLING APPARATUS", which is commonly assigned to the same assignee as the present application.

BACKGROUND OF THE INVENTION

1. Field of the Invention

The present invention relates to a coin sorting apparatus, more particularly to an apparatus for selecting a specific denomination of coins and counting a predetermined number of the coins.

2. Description of the Prior Art

In a coin handling apparatus, specifically in a coin sorting and wrapping apparatus, conventionally a predetermined denomination of coin is selected from a plurality of denominations of coins in response to the width of the coins to be wrapped by a wrapping sheet in the form of a stack of a predetermined number of coins. In order to exclude larger coins in diameter than the predetermined denomination of coins among many denominations of coins introduced to the apparatus, Japanese Utility model publication No. 62-30141 discloses a larger coin excluding mechanism of a coin handling apparatus wherein coins larger in diameter than a predetermined denomination of coins climb up to a slant surface formed at one side of a curved coin handling path because of the larger diameter so that the larger coins are separated from other coins which are conveyed along the curved path. However, in order to perform a reliable separation of the larger coins in this mechanism, the length of the curved coin handling path tends to increase to thereby make the apparatus large in size. Further, there is a possibility that some larger diameter coins on the surface of the curved path is happened to be carried to the next section without being excluded.

There has been proposed in Japanese Patent application No. 62-65348 which is assigned by the same assignee as the present application, a coin handling apparatus similar to the above apparatus disclosed in the Japanese Utility Model Publication No. 62-30141. In this apparatus, the larger coin than the predetermined coin is urged against a lead wall of the path at one side by means of a conveyer belt which is adapted to convey all the coins introduced into the path and is led on the slant surface of the path at the other side to be excluded from the path.

Coins other than the larger coins excluded are introduced along the lead wall into a next section in which the smaller coins than the predetermined denomination of coins are excluded. However, this apparatus is disadvantageous in that some of the predetermined denomination of coins or the smaller coin might be excluded from the path because of an insufficient force produced by the conveyor belt for urging the coins against the lead wall.

Moreover, it is difficult to control the width of the path because it is curved in the separating zone, As a result, it is likely to fail to separate the larger coins properly.

SUMMARY OF THE INVENTION

It is therefore an object of the present invention to provide a coin sorting apparatus which can sort a plurality of denominations of coins.

It is another object of the present invention to provide a coin sorting apparatus which can separate both coins which are smaller and larger in diameter than a predetermined denomination of coin from a coin handling path or line.

It is further object of the present invention to provide a coin sorting apparatus which can ensure a separation of the larger and smaller coins than the predetermined denomination of coins.

It is still further object of the present invention to provide a reliable and compact coin sorting apparatus which can select a predetermined denomination of coins.

According to the present invention, the above and other objects can be accomplished by a coin sorting apparatus comprising a coin receiving section provided with a rotary disc for receiving various denominations of coins of various diameters, an excluding path constituting by guide plate means disposed at one side of the path and communicated with the rotary disc for engaging with a peripheral portion of the coin carried, guide member means disposed at the other side of the excluding path and formed with a slant surface on which a larger diameter coin than the predetermined denomination of coin is engaged to climb up to be excluded from the excluding path and a lead wall for engaging with a coin other than the coin to be excluded from the excluding path and restricting means disposed over the slant surface of the guide member means and swingably mounted on the guide member means for engaging the larger diameter coin introduced on the slant surface, a selecting path provided with selecting rail means for excluding the smaller diameter coin smaller in diameter than the predetermined denomination of coins and pass them to a small coin container to select only the predetermined denomination of coin.

Preferably, a number of plural denominations of coins are introduced into the coin sorting apparatus. The respective denominations of coins introduced into the apparatus are discriminated based on the material, size and the like by means of sensors so that the number of the respective denominations of coins and therefore the total amount of money introduced into the apparatus can be calculated before the coins are subjected to any sorting operation.

In the separating section, the larger coins climb up to the slant surface gradually ascending in the downstream direction of the path, which surface is formed at one side of the path so that the larger coins are conveyed in an inclined position and keep straight on into a container. On the other hand, the coins smaller in diameter other than the larger coins move along the lead wall formed on the guide plate means of the path, which curves at the down stream portion thereof toward the selecting section, in a manner that the ends of the coins is brought into contact with an arcuate leading side surface of the path. The remaining coins are introduced into the selecting section in which coins smaller in diameter than the predetermined coins drop out of a conveyance path of an adjusted width to be removed from the handling line so that only a predetermined denomination of coins are fed to the next section such as an accumulating section and thereafter to the wrapping section.

The above and other objects of the present invention will be apparent from the following descriptions of preferred embodiments taking reference to the accompanying drawings.

DESCRIPTION OF THE PREFERRED EMBODIMENTS

Figure 1:
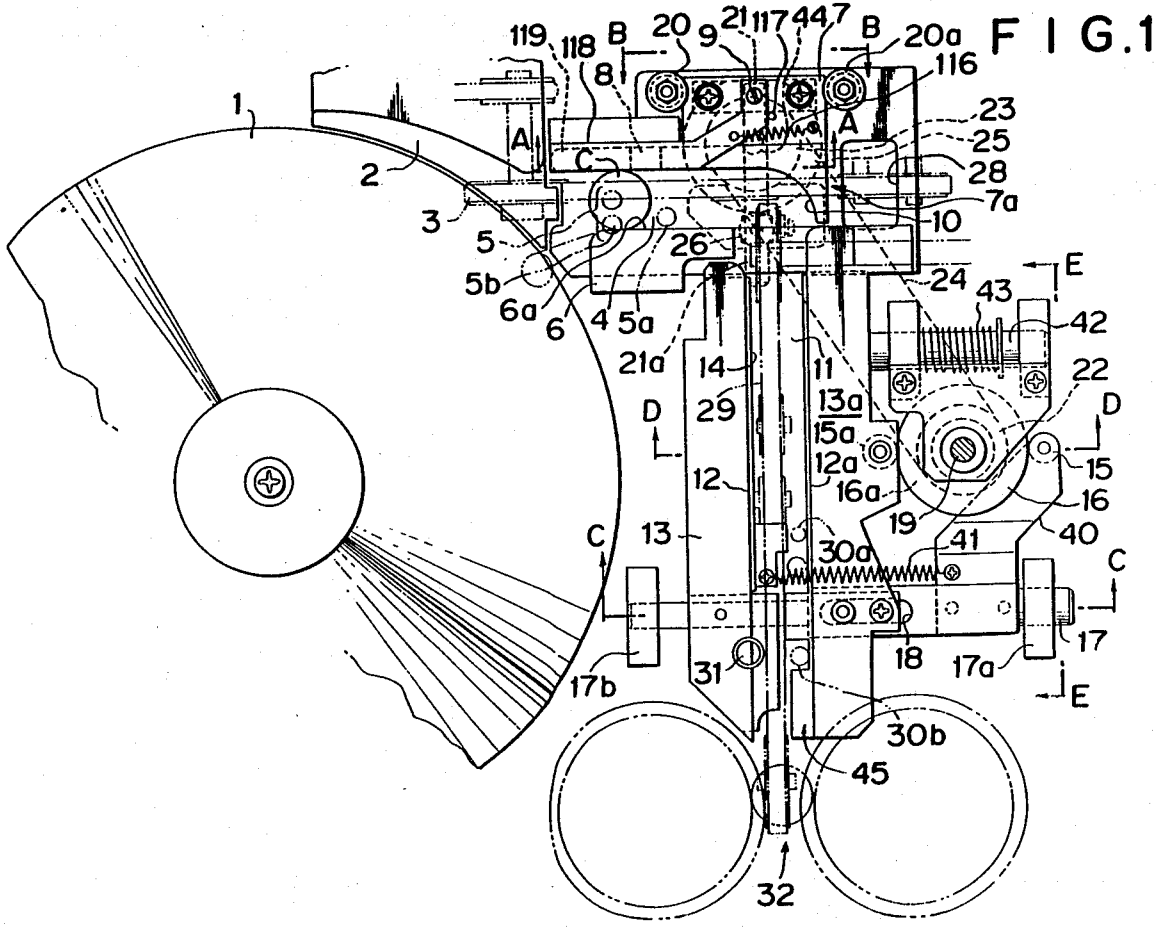
FIG. 1 is a plan view of a coin sorting apparatus in accordance with the present invention.
Figure 2:
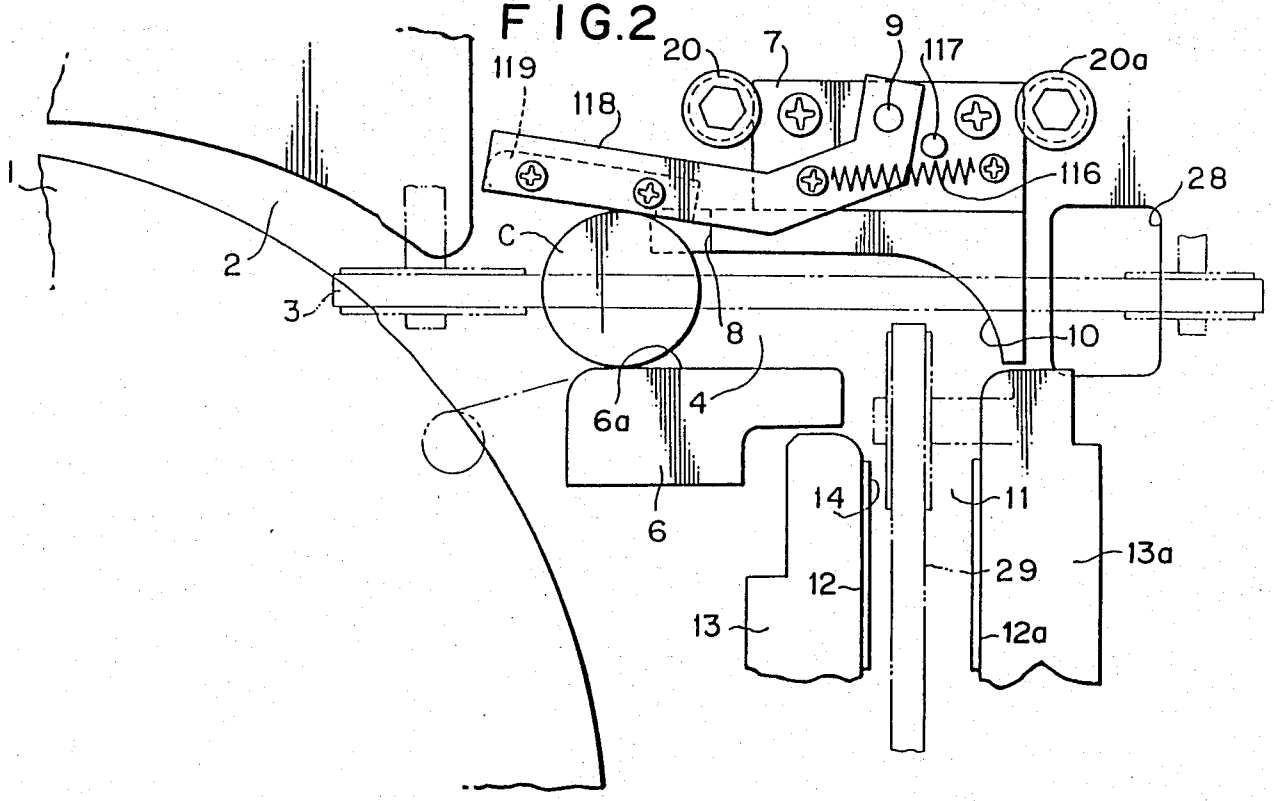
FIG. 2 is a plan view showing an essential portion of the coin sorting apparatus shown in FIG. 1.

Referring to the drawings, particularly to FIGS. 1 and 2, there is shown a coin sorting apparatus comprising a coin introducing section 2 including a rotary disc 1 for introducing coins fed thereto to a peripheral portion thereof. The apparatus is provided downward of the disc 1 with a coin passage member 4 for constituting a coin conveying path in which all the coins from the disc 1 are conveyed downstream by means of a conveyor belt 3 one by one through a discriminating section 5 provided halfway of the passage member 4.

The discriminating section 5 is comprised of a material discriminating section 5*a* for discriminating the material of the coins fed thereto and a diameter discriminating section 5*b* for detecting the diameter of the coins whereby denomination of the coin is discriminated. The material discriminating section 5*a* is usually provided with a detecting coil device for detecting a change in the magnitude of a magnetic flux thereof when a coin passes through the magnetic field thereof. The diameter discriminating section 5*b* is usually provided with photo array image sensors for detecting the amount of light interrupted by each coin. Signals from the coil device and the image sensors are fed to a control unit (not shown) which compares the signals with given data stored therein to determine the denomination of the coin. In the discriminating section 5, the coins fed thereto are counted by kind so that the total amount of the money can be calculated.

In addition to FIG. 1, referring to FIG. 2, there are disposed a guide plate 6 and a separating guide member 7 at the downstream portion of the passage member 4. The separating guide member 7 can be moved to adjust the distance between a base surface 6*a* of the guide plate 6 and guide member 7 in accordance with a diameter of a coin introduced.

Figure 3:
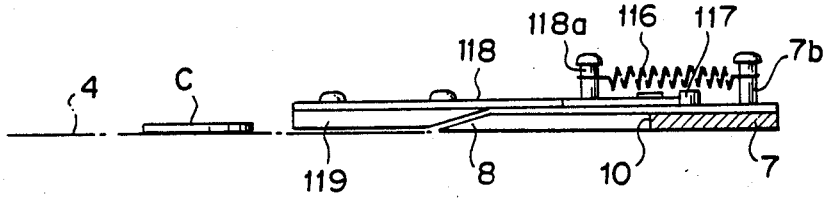
FIG. 3 is a sectional view taken along a line A—A in FIG. 1.

Further referring to FIG. 3, the separating guide member 7 is provided with a slant surface 8 which ascends gradually from the level of bottom surface of the passage member 4 in the down stream direction of the conveying line. An arm member 118 is pivotally mounted at one end on a shaft 9 which is fixed to the separating guide member 7. The arm member 118 is urged against a stopper 117 by means of a spring 116 through hook members 118*a* and 7*b*. The arm member 118 is formed with a coin restricting portion 119 at the other end over the slant surface 8. The guide member 7 is formed with a lead wall 10 which extends vertically downwardly from one side end of the slant surface 8.

The restricting portion 119 is formed on the arm member 118 pivotally connected with the guide member 7. The guide member 7 is movable to adjust a distance between the guide plate 6 and the guide member 7 in accordance with a diameter of a coin introduced there. The distance between the guide plate 6 and the guide member 7 is maintained at substantially a diameter of the predetermined denomination of a coin. The arm member 118 is normally brought into contact with stopper 117 fixed to the guide member means. The restricting portion is located over the slant surface 8 of the guide member 7 and an end surface of the restricting portion 119 aligns with the lead wall 10. An end surface of the restricting portion 119 and the lead wall 10 extend vertically.

The lead wall 10 is formed with a curved portion at the downstream portion so as to receive a coin along therewith. The restricting portion 119 contacts with a coin of a diameter larger than the predetermined denomination of coin and is swingably retracted to allow the coin to climb up on the slant surface of the guide member 7.

Figure 5:
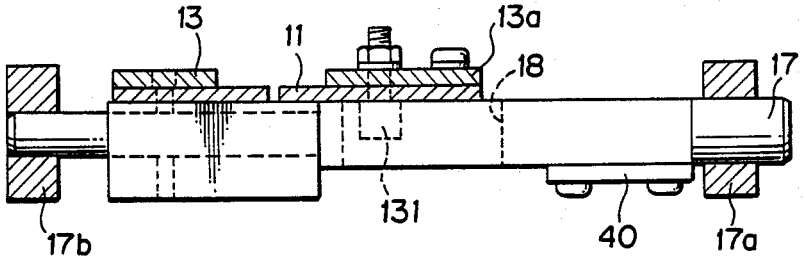
FIG. 5 is a sectional view take along a line C—C in FIG. 1.
Figure 7:
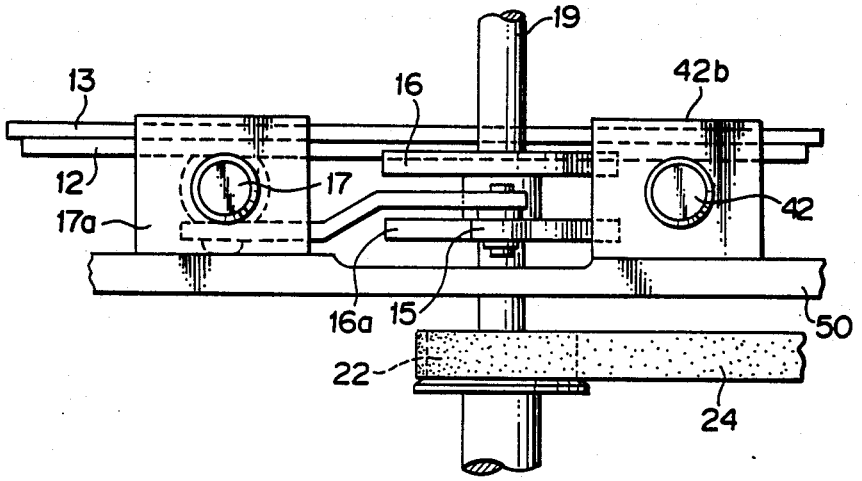
FIG. 7 is a sectional view taken along a line E—E in FIG. 1.

The lead wall 10 is adapted to contact coins for deflecting them toward a selecting section those among all the coins fed to the conveying line that are larger in diameter than a predetermined denomination of coins so as to remove them from the conveying line. It will be understood that the inclined surface 8 of the passage member 4, guide plate 6, and the slant surface 8 and the lead wall 10 of the guide member 7 constitute a larger coin separating section 7*a*. The selecting section 11 is arranged at a right angle to the larger coin separating section 7*a* downstream thereof with regard to the coin conveying line. The selecting section 11 is provided with selecting guides 13, 13*a* having rails 12, 12*a* respectively. There is formed a groove 14 between the guides 13, 13*a*. The selecting guide 13 is fixed to a supporting rod 17 which is slidably mounted on a base member 50 through brackets 17*a*, 17*b* at the opposite ends in the longitudinal direction thereof, that is, in the traverse direction of the conveyer line as shown in FIG. 7. On the supporting rod 17 is also mounted a support 40 of a cam follower 15 which is urged against an adjusting cam 16*a* for adjustinq the width of the space between the guides 13, 13*a* by means of a coil spring 41. The guide 13*a* is provided at one end portion with projections 131 which are received in an elongated opening 18 formed on the rod 17 as shown in FIG. 5 so that the guide 13*a* is engaged with the rod 17 and carried thereby. Now referring to FIG. 2 and 7, the guide 13*a* is connected at the other end to a supporting rod 42 which is slidably mounted on the base member 50 through brackets 42*a* and 42*b* in the longitudinal direction of the rod 42, that is, in the transverse direction of the conveyer line. The guide 13*a* is provided with a cam follower 15*a*. The rod 42 is engaged with a coil spring 43 so that the cam follower 15*a* of the guide 13*a* is urged against the cam 16 as shown in FIG. 1.

Figure 6:
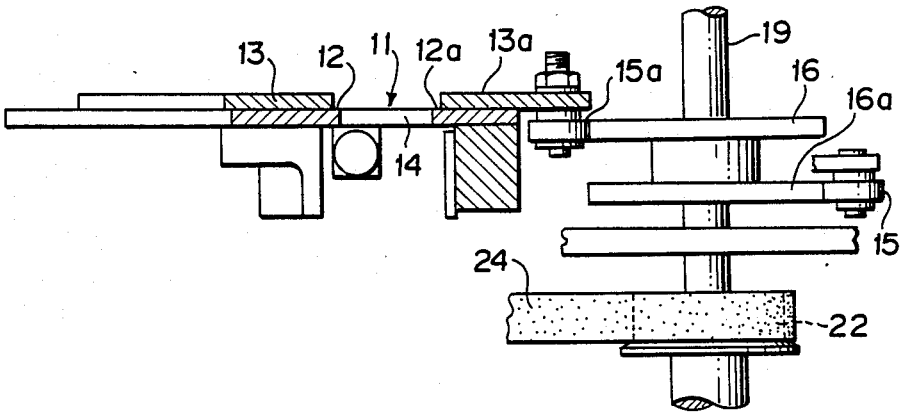
FIG. 6 is a sectional view taken along a line D—D in FIG. 1.

The cam faces of the cams 16, 16*a* are formed depending on the diameter of the predetermined denomination of coins so that the guides 13, 13*a* can be moved symmetrically to each other in the traverse direction of the conveying line by controlling an adjusting shaft 19 as shown in FIG. 6.

Figure 4:
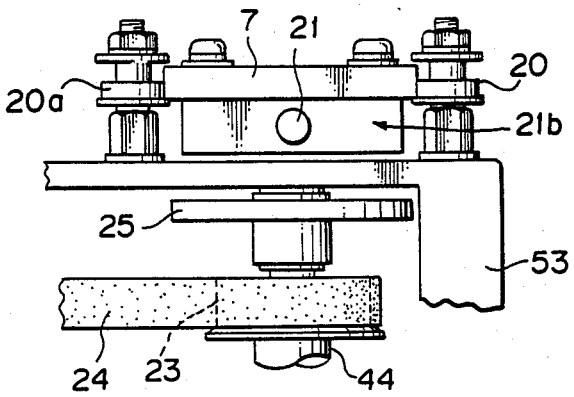
FIG. 4 is a sectional view taken along a line B—B in FIG. 1.

The separating guide member 7 is mounted between guide rollers 20, 20*a* on a supporting rod 21 and is brought into engagement with the roller 20, 20*a* so that the guide member 7 is limited to be moved with the rod 21 in the longitudinal direction of the rod 21 as shown in FIG. 4. The rod 21 is slidably engaged with brackets 21*a* and 21*b*, the bracket 21*a* is slidably engaged with brackets 21 and 21*b*, the bracket 21*a* being fixed to the base member 50. The rod 21 is provided with a projection extended downwardly. The projection is provided with a cam follower 26 which is brought into engagement with an adjusting cam 25. The cam 25 is mounted on a cam shaft 44 which is carried for rotation by a base member 53 as shown in FIG. 4. The shaft 44 is provided with a pulley 23 which is engaged through a belt 24 with a pulley 22 mounted on the shaft 19 as shown in FIG. 2 and 3. Thus, when the cam shaft 44 is rotated by the belt 24, the supporting rod moves in the longitudinal direction so that the guide member 7 is moved to adjust the distance between the guide plate 6 and the guide member 7.

As mentioned above, it will be understood that the positions of guide member 7 and the guides 13, 13*a* can be controlled merely by a rotation of the adjusting shaft 19.

In operation, all the coins fed into the disc 1 are moved to the peripheral portion of the disc 1 by centrifugal force as the disc 1 rotates. Thereafter the coins are fed downward of the conveyor belt 3 and passed toward the passage member 4. On the passage member 4, passing through the discriminating section 5, the coins are discriminated with regard to the materials and diameters and thereafter counted as mentioned above. A coin of a diameter not more than the predetermined denomination of coin is conveyed along the passage member 4 and between the base surface 5 and the lead wall 10. However, a coin of a diameter larger than the predetermined denomination of coin climbs up on the slant surface 8 of the guide member 7 against the restricting portion 119 of the arm member 118, as shown in FIG. 2. The coin C is carried by the conveyor belt 3 to move straight and excluded from the conveying line of the smaller coins which are brought into engagement with the lead wall 10 so that the coin C of the larger diameter is introduced into an opening 28 for separating coins of larger diameters and thereafter to a coin box.

The predetermined denomination of coins and coins having a smaller diameter pass through the passage member 4 and are brought into contact with the lead wall 10 formed as a stepped portion by the slant surface 8. Then the coins of the smaller diameter move along the arcuate lead wall 10 so as to be deflected toward the selecting section 11. It should be noted that the arcuate lead wall 10 is provided at the downstream portion of the guide member and therefore that at the entrance of the coin separating section 7*a*, all the coins keep straight on but only the larger diameter coins climb up to the slant surface 8 to be separated from the others.

Thereafter the remaining coins or the coins other than the larger diameter coins are introduced into the selecting section 11 by means of the conveyor belt 29. In the selecting section 11, the predetermined denomination of coins are conveyed on the rail 12, 12*a* but coins having a smaller diameter than the predetermined denomination of coins drop from the separating passage or groove 14 formed by the rails 12, 12*a* to be passed into a coin box for the smaller coins.

Thus, only the predetermined denomination of coins are conveyed to reach the downstream end of the rails 12, 12*a*. In the vicinity of the end portion of the rails 12, 12*a* there is provided a detecting section including various sensors for discriminating damaged coins and for detecting coins other than the predetermined denomination of coins by comparing with the data from the discriminating section 5 and for counting the number of the predetermined denomination of coins.

A stopper 31 is adapted to limit the stream of the coins from a discharging end 45 of the rails 12, 12*a* to the accumulating section 32 when the number of the predetermined denomination of coins being introduced to the accumulating section reaches a predetermined value.

Thus, according to the present invention, various denominations or sizes coins can be sorted because the apparatus can remove both larger and smaller denomination of coins than a predetermined denomination of coin.

The invention has thus been shown and described with reference to specific embodiments. However, it should be noted that the invention is not limited to the details of the illustrated structures but changes and modifications may be made without departing from the scope of the appended claims.

I claim:

1. A coin sorting apparatus comprising:

a rotary disc disposed in a substantially horizontal plane for rotation so as to receive and distribute various denominations of coins of various diameters, guide plate means disposed adjacent to a periphery of said rotary disc and extending substantially tangentially therefrom for engaging with an end surface of a coin which is introduced from said rotary disc, guide member means disposed spaced from said guide plate means and extending in parallel with the guide plate means for defining a path of travel with said guide plate means, a slanted surface formed on said guide member means for engaging with a larger diameter coin than a diameter of a predetermined denomination of coin so that the larger diameter coins climb up the slanted surface so as to be separated from the predetermined denomination of coin and coins of a smaller diameter than the diameter of the predetermined denomination of coin, a lead wall formed on the guide member means for engaging with an end surface of the predetermined denomination of coin and the smaller diameter coin to lead them downstream along the guide plate means, restricting means disposed over the slated surface of the guide member means for resiliently engaging with the larger diameter coins which are introduced to the slanted surface as the larger diameter coins move downstream, a pair of selecting rail means disposed in parallel with each other at a position downstream and adjacent to the guide plate means and the guide member means for engaging with the predetermined denomination of coin and leading the predetermined denomination of coin downstream and for excluding the smaller diameter coin by passage of the smaller diameter coin between said selecting rail means due to gravity, said lead wall of said guide member means being formed with an arcuate portion for deflecting the predetermined denomination of coin and the smaller diameter coin therealong toward said selecting rail means away from a direction in which the larger diameter coin is led.

2. A coin sorting apparatus in accordance with claim 1, wherein said restricting means is formed on arm means pivotally connected with said guide member means.

3. A coin sorting apparatus in accordance with claim 1, wherein said guide member means is movable to adjust a space between said guide plate means and said guide member means in accordance with a diameter of a coin to be introduced into the space.

4. A coin sorting apparatus in accordance with claim 3, wherein the space between said guide plate means and said guide member means is maintained at substantially a diameter of the predetermined denomination of a coin.

5. A coin sorting apparatus in accordance with claim 2 wherein the arm means is normally brought into contact with stopper means fixed to the guide member means.

6. A coin sorting apparatus in accordance with claim 2 wherein the restricting means is located over the slant surface of the guide member means and an end surface of the restricting means aligns with the lead wall.

7. A coin sorting apparatus in accordance with claim 6, wherein an end surface of said restricting means and said lead wall extend vertically.

8. A coin sorting apparatus in accordance with claim 1, further comprising first conveyor belt means disposed between the guide plate means and the guide member means for carrying coins downstream and second conveyor means disposed between the selecting rail means for carrying coins downstream.

9. A coin sorting apparatus in accordance with claim 1, further comprising means for controlling a space between the selecting rail means in relation to a space between the guide plate means and the guide member means.

* * * * *